US007779592B2

(12) United States Patent
Bernardi et al.

(10) Patent No.: US 7,779,592 B2
(45) Date of Patent: Aug. 24, 2010

(54) SUBSTRATE WITH MEMBRANE SEAM PLATES FIXED THEREON FOR PRECISE PLACEMENT OF SEAM PLATES ON ROOF DECKING ASSEMBLIES

(75) Inventors: John V. Bernardi, Arlington Heights, IL (US); Paul M. Larson, Hoffman Estates, IL (US); Frank K. Villari, Oak Park, IL (US); Cheryl L. Panasik, Elburn, IL (US); Manuel C. Enriquez, Morton Grove, IL (US); Daniel T. Schmidt, Arlington Heights, IL (US)

(73) Assignee: OMG Roofing, Inc., Agawam, MA (US)

( * ) Notice: Subject to any disclaimer, the term of this patent is extended or adjusted under 35 U.S.C. 154(b) by 1515 days.

(21) Appl. No.: 10/775,171

(22) Filed: Feb. 11, 2004

(65) Prior Publication Data

US 2004/0187422 A1 Sep. 30, 2004

Related U.S. Application Data

(63) Continuation-in-part of application No. 10/394,191, filed on Mar. 24, 2003, now abandoned.

(51) Int. Cl.
*E04C 3/00* (2006.01)
*E04D 1/36* (2006.01)

(52) U.S. Cl. ..... 52/463; 52/410; 411/545

(58) Field of Classification Search ..... 52/410, 52/408, 462, 463, 512, 520, 528; 411/531, 411/545, 461, 462, 463, 464, 465, 466
See application file for complete search history.

(56) References Cited

U.S. PATENT DOCUMENTS 4,149,320 A 4/1979 Troyer et al.

(Continued)

FOREIGN PATENT DOCUMENTS

EP 0 347 403 12/1989

(Continued)

*Primary Examiner*—Richard E. Chilcot, Jr.
*Assistant Examiner*—Chi Q Nguyen
(74) *Attorney, Agent, or Firm*—Alix, Yale & Ristas, LLP

(57) ABSTRACT

A seam plate implement assembly comprises a substrate having a longitudinal extent and upon which a plurality of seam plates are fixedly disposed at predetermined uniformly spaced longitudinal positions which correspond to the transverse spacing defined between the crest portions of an underlying corrugated roof decking substructure. In this manner, when a particular one of the membrane plates is fixedly secured to one of the crest portions of the underlying corrugated roof decking substructure by suitable threaded fasteners, the remaining membrane plates will be automatically properly aligned with the other crest portions of the underlying corrugated roof decking substructure so as to automatically ensure proper and secure fixation of the seam plates upon the roof decking assembly. When the seam plate or membrane plate implement assembly is used with a non-corrugated roof decking substructure, the seam plates are disposed at predeterminedly spaced locations upon the substrate so as to provide the environmental membranes with sufficient uplifting force resistance. The substrate may have a C-shaped or V-shaped cross-sectional configuration for enveloping each one of the seam plates, or may comprise a mesh member through which prong members of the seam plates are extended and folded so as to secure the seam plates upon the substrate.

34 Claims, 7 Drawing Sheets

U.S. PATENT DOCUMENTS 4,301,596 A 11/1981 Sedlock
4,382,353 A * 5/1983 Kelly ..... 52/506.05
4,493,175 A * 1/1985 Coppola, Jr. ..... 52/410
4,653,246 A * 3/1987 Hepler ..... 52/787.11
4,671,036 A * 6/1987 Sullivan ..... 52/518
4,679,325 A 7/1987 Sweatman
4,686,808 A * 8/1987 Triplett ..... 52/410
4,718,211 A * 1/1988 Russell et al. ..... 52/409
4,726,164 A * 2/1988 Reinwall et al. ..... 52/410
4,763,456 A * 8/1988 Giannuzzi ..... 52/410
4,787,188 A * 11/1988 Murphy ..... 52/410
4,793,116 A * 12/1988 Whitman ..... 52/410
4,834,828 A 5/1989 Murphy
4,945,699 A 8/1990 Murphy
5,018,279 A 5/1991 Williams
5,018,329 A * 5/1991 Hasan et al. ..... 52/410
5,035,028 A * 7/1991 Lemke ..... 24/336
5,056,234 A 10/1991 Han
5,125,552 A 6/1992 Medwed
5,204,148 A * 4/1993 Alexander et al. ..... 428/41.8
5,230,158 A 7/1993 Wall
5,319,908 A * 6/1994 Van Erden et al. ..... 52/410
5,469,671 A 11/1995 Rathgeber et al.
5,546,671 A 8/1996 Kehoe
5,562,380 A * 10/1996 Hempfling et al. ..... 411/542
5,623,802 A 4/1997 Boushek et al.
5,711,116 A 1/1998 Hasan
5,724,747 A 3/1998 Poorman
5,800,891 A * 9/1998 Wasitis ..... 428/42.2
5,918,439 A 7/1999 Metzer et al.
5,951,225 A * 9/1999 Osterle et al. ..... 411/545
6,004,645 A 12/1999 Hubbard
6,055,786 A 5/2000 Hubbard et al.
6,187,122 B1 2/2001 Hubbard et al.
6,250,034 B1 6/2001 Hulsey
6,338,232 B1 * 1/2002 Yamanaka et al. ..... 52/746.1
6,349,519 B1 2/2002 Beller
6,378,197 B1 4/2002 Hansen
6,427,412 B1 8/2002 Mayle et al.
6,478,209 B1 11/2002 Bruins et al.
6,523,275 B2 2/2003 Medford et al.
6,689,449 B2 2/2004 Hasan et al.
6,764,260 B1 * 7/2004 Nebesnak et al. ..... 411/82
2001/0030138 A1 10/2001 Bruins et al.
2001/0034954 A1 11/2001 Medford et al.

FOREIGN PATENT DOCUMENTS

WO WO 96/30609 10/1996

* cited by examiner

SUBSTRATE WITH MEMBRANE SEAM PLATES FIXED THEREON FOR PRECISE PLACEMENT OF SEAM PLATES ON ROOF DECKING ASSEMBLIES

CROSS-REFERENCE TO RELATED PATENT APPLICATIONS

This patent application is a Continuation-in-Part (CIP) of U.S. patent application Ser. No. 10/394,191 which is entitled SUBSTRATE WITH MEMBRANE SEAM PLATES FIXED THEREON FOR PRECISE PLACEMENT OF SEAM PLATES ON ROOF DECKING ASSEMBLIES and which was filed on Mar. 24, 2003 now abandoned in the name of John V. Bernardi et al.

FIELD OF THE INVENTION

The present invention relates generally to roof decking assemblies,.and more particularly to a new and improved substrate which has a plurality of seam plates fixedly secured thereon, at predeterminedly spaced locations thereof, for precisely locating the seam plates with respect to the crest portions of an underlying corrugated metal roof decking substructure in order to ensure that when the seam plates are to be fixedly secured to the underlying corrugated metal roof decking substructure by means of suitable fasteners, the fasteners will in fact be fixedly secured within the crest portions of the underlying corrugated metal roof decking substructure, or alternatively, for locating the seam plates at predeterminedly spaced positions with respect to underlying wood or concrete decking substructures whereby roof decking membranes, which are adapted to overlie or be disposed atop any one of several different types of underlying roof decking assemblies, comprising, for example, any one of the aforenoted underlying roof decking substructures and insulation panels mounted upon the underlying roof decking substructures, in order to protect such underlying roof decking assemblies under various environmental conditions, will be properly secured to the underlying roof decking assemblies so as to remain secured to the underlying roof decking assemblies despite environmental conditions comprising, for example, uplifting wind forces and the like.

BACKGROUND OF THE INVENTION

In the building industry, roof decking components, structural members, or substructures conventionally have insulation slabs or panels disposed thereon, and weather-protection membranes are in turn adapted to be secured atop the insulation slabs or panels so as to protect the same from deterioration which would otherwise occur as a result of being exposed to various environmental or weather conditions. The membranes and the underlying insulation slabs or panels are conventionally secured to the underlying roof decking substructures by means of fastener assemblies which may comprise, for example, a combination of roofing, seam, insulation, or membrane plates, batten strips, or batten bars, which are adapted to be disposed atop the membranes, whereupon, in turn, suitable threaded fasteners typically secure the plates, batten strips, or batten bars to the underlying roof decking substructures. Typical or conventional, PRIOR ART membrane, plate, and batten strip or batten bar mounting systems are disclosed, for example, within U.S. Pat. No. 6,250,034 which issued on Jun. 26, 2001 to Hulsey, U.S. Pat. No. 6,055,786 which issued on May 2, 2000 to Hubbard et al., U.S. Pat. No. 6,004,645 which issued on Dec. 21, 1999 to Hubbard, U.S. Pat. No. 5,711,116 which issued on Jan. 27, 1998 to Hasan, U.S. Pat. No. 5,469,671 which issued on Nov. 28, 1995 to Rathgeber et al., and U.S. Pat. No. 4,945,699 which issued on Aug. 7, 1990 to Murphy.

With reference initially being made to FIG. 1, which corresponds substantially to FIG. 4 of the aforenoted United States patent to Hulsey, a conventional PRIOR ART roof decking assembly is disclosed and is generally indicated by the reference character 1. A metal roof decking substructure or component is disclosed at 12, and it is seen that the metal roof decking substructure 12 has a corrugated configuration comprising a plurality of transversely spaced crest portions 14 and a plurality of transversely spaced root portions 16 interposed between the crest portions 14. An insulation slab or panel 66 is disposed atop the metal roof decking substructure 12 and is adapted to be secured to the metal roof decking substructure 12 by means of a plurality of transversely spaced threaded fasteners which are adapted to be threadedly engaged within predetermined ones of the transversely spaced crest portions 14 of the metal roof decking substructure 12. Environmental-protection or weather-resistant membranes 54,62, are adapted to be disposed and secured atop the insulation slab or panel 66, and in view of the fact that the roof decking membranes are obviously smaller in size than the entire expanse of the roof decking assembly, the roof decking membranes 54,62 are adapted to be effectively mated together by means of a membrane fastening system 50 which comprises the welding or gluing together of the membranes 54,62 along seam lines 60, 70. Securement of the roof decking membranes 54,62 permits the membranes 54,62 to properly withstand environmental uplifting wind forces 74,78.

Continuing further, in accordance with conventional roof decking membrane fixation techniques, a seam plate or membrane plate 10 is adapted to be secured upon the upper surface portion of the insulation slab or panel 66, with a seam edge portion of one of the roof decking membranes 62 being interposed between the undersurface portion of the seam plate or membrane plate 10 and the upper surface portion of the insulation slab or panel 66, by means of a plurality of threaded fasteners 68, only one of which is disclosed, so as to effectively fix the roof decking membranes 54,62 to the underlying roof decking assembly comprising the metal roof decking substructure 12 and the insulation slab or panel 66. Various techniques may be employed in connection with the formation of the roof decking membrane seams 60,70 and the actual fixation of the roof decking membranes 54,62 to the underlying metal roof decking assembly 12,66, however, the critically important feature, characteristic of the operation or technique for fixing the roof decking membranes 54,62 to the underlying metal roof decking assembly 12,66, is to ensure that each seam plate or membrane plate 10 is precisely aligned with one of the crest portions 14 of the underlying metal roof decking substructure 12 so as to, in turn, ensure the fact that each one of the threaded fasteners 68 will be properly threadedly engaged within one of the crest portions 14 of the underlying metal roof decking substructure 12. Accordingly, various additional techniques have conventionally been implemented in connection with an attempt to precisely locate the seam plates or membrane plates with respect to the crest portions of the underlying metal roof decking substructure in order to ensure the fact that each one of the threaded fasteners, used for securing the seam plates or membranes upon the underlying membranes, will be properly threadedly engaged within one of the crest portions of the underlying metal roof decking substructure. One such technique comprises the placement of suitable markings upon the membranes, at predetermined positions spaced along the membranes, such that when the membranes are disposed atop the insulation slab or panel in such a manner that the markings are positionally aligned with the crest portions of the underlying metal roof decking substructure, the markings will effectively indicate to installation personnel the locations at which the membrane plates or seam plates are to be placed and secured as a result of the threaded fasteners being threadedly engaged within the crest portions of the underlying metal roof decking substructure.

In addition to the fact that the placement of the membrane plates or seam plates at the individually marked locations is time-consuming, operational problems have also been experienced in connection with such techniques. For example, in connection with this particular installation technique, it has been experienced sometimes that, during the time that occurs between the placement of the membranes atop the insulation slab or panel and the time that the seam plates or membrane plates are placed upon the membranes, the membranes may have moved, such as, for example, under environmental conditions. Alternatively, due to the multitude of workmen present upon the job site, the seam plates or membrane plates may have been inadvertently moved. In either instance, it is sometimes the case that the seam plates or membrane plates are not in fact properly aligned with the crest portions of the underlying metal roof decking substructure whereby the threaded fasteners will not be properly engaged within the crest portions of the underlying metal roof decking substructure. Accordingly, the seam plates or membrane plates will not be securely fastened to the underlying metal roof decking substructure so as to in turn not be capable of properly maintaining the environmental membranes fixed upon the insulation slab or panel under the various environmental conditions.

Alternatively, if it is realized that a particular fastener has not in fact been properly threadedly engaged within the crest portion of the underlying metal roof decking substructure, the threaded fastener must be removed and reinserted at a different location. This operation is obviously additionally time-consuming, however, still further, additional holes have now been formed within the environmental membranes which could lead to enhanced deterioration of the membranes as well as the underlying insulation slabs or panels. Lastly, when roof decking assemblies, comprising, for example, non-corrugated concrete or wood roof decking substructures, insulation slabs or panels, and environmental membranes, are to be assembled, it is likewise critically important to secure the environmental membranes at predeterminedly spaced locations with respect to the underlying insulation slabs or panels, and the concrete or wood roof decking substructures, so as to ensure the secure fixation of the environmental membranes upon the underlying insulation slabs or panels, and the concrete or wood roof decking substructures, despite the presence of uplifting environmental wind forces.

As disclosed, for example, within U.S. Pat. No. 5,918,439 which issued to Metzer et al. on Jul. 6, 1999, U.S. Pat. No. 5,724,747 which issued to Poorman on Mar. 10, 1998, U.S. Pat. No. 5,230,158 which issued to Wall on Jul. 27, 1993, U.S. Pat. No. 5,056,234 which issued to Han on Oct. 15, 1991, U.S. Pat. No. 4,679,325 which issued to Sweatman on Jul. 14, 1987, U.S. Pat. No. 4,301,596 which issued to Sedlock on Nov. 24, 1981, U.S. Pat. No. 4,149,320 which issued to Troyer et al. on Apr. 17, 1979, U.S. patent application Publication 2001/0034954 of Medford et al. which was published on Nov. 1, 2001, and PCT Patent Application WO 96/30609 of Hungarter which was published on Oct. 3, 1996, various measuring or aligning devices, implements, or tools are also known for use in connection with the installation of roofing shingles, roof framing members, stud members, and the like. None of these devices, tools, or implements, however, would be useable in a viable manner, in connection with the aforenoted installation of seam plates or membrane plates, in order to overcome the various operational disadvantages or drawbacks characteristic of conventional techniques for installing seam plates or membrane plates upon the roof decking assemblies, wherein it is desired to ensure the fact that the seam plates or membrane plates would be properly positioned with respect to the underlying environmental membranes such that when the threaded fasteners, for securing the seam plates or membrane plates upon the underlying roof decking substructure, are to be threadedly engaged within the underlying roof decking substructure, the threaded fasteners will in fact be threadedly engaged either within the crest portions of the underlying metal roof decking substructure, or at predeterminedly spaced locations with respect to underlying concrete or wood decking substructures, in order to ensure the secure fixation of the environmental membranes upon the underlying insulation slabs or panels, and the metal, concrete, or wood roof decking substructures, despite the presence of uplifting environmental wind forces.

A need therefore exists in the art for a new and improved device or implement which will be capable of readily, easily, and rapidly positioning or aligning seam plates or membrane plates with respect to underlying roof decking substructures such that when the threaded fasteners, for securing the seam plates or membrane plates to underlying roof decking substructures, are to be threadedly engaged within underlying corrugated metal roof decking substructures, the threaded fasteners will in fact be threadedly engaged within the crest portions of the underlying corrugated metal roof decking substructures, or alternatively, when the threaded fasteners are to be threadedly engaged within underlying non-corrugated concrete or wood roof decking substructures, the threaded fasteners will in fact be threadedly engaged within the underlying non-corrugated concrete or wood roof decking substructures at predeterminedly spaced locations in order to ensure the secure fixation of the environmental membranes upon the underlying insulation slabs or panels, and the metal, concrete, or wood roof decking substructures, despite the presence of uplifting environmental wind forces.

SUMMARY OF THE INVENTION

The foregoing and other objectives are achieved in accordance with the teachings and principles of the present invention through the provision of a new and improved device or implement which comprises, for example, a substrate having a longitudinal extent and upon which a plurality of seam plates or membrane plates are fixedly disposed at predetermined uniformly spaced longitudinal positions which correspond to the transverse spacing defined between the crest portions of underlying corrugated metal roof decking substructures, or alternatively which can be secured at predeterminedly spaced locations upon underlying non-corrugated concrete or wood roof decking substructures. The substrate may have a requisite amount of flexibility so as to permit the same to be coiled or otherwise packaged for storage and transportation purposes, however, when the same is to be used at a particular job site, the substrate is uncoiled or unpacked from its storage position. Subsequently, when, for example, the leading one of the seam plates or membrane plates, fixedly secured upon the substrate, is positionally aligned with one of the crest portions of the underlying corrugated metal roof decking substructure, or is positionally located at an initial start position with respect to an underlying non-corrugated concrete or wood roof decking substructure, and still further, when such leading one of the seam plates or membrane plates is in fact fixedly secured to the underlying roof decking substructure as a result of one of the threaded fasteners being passed through such leading seam plate or membrane plate and threadedly engaged within the corresponding crest portion of the underlying corrugated metal roof decking substructure, or within the underlying non-corrugated concrete or wood substructure, then the other seam plates or membrane plates are automatically or inherently positionally aligned with subsequent crest portions of the underlying corrugated metal roof decking substructure, or at predeterminedly spaced locations with respect to the underlying non-corrugated concrete or wood roof decking substructure.

In this manner, all of the seam plates or membrane plates will be able to be securely fastened to the underlying roof decking substructure, by means of their respective fasteners, whereby the environmental membranes will be fixedly maintained in their overlying states upon the roof decking assembly insulation slabs or panels. In addition, it is noted that in accordance with the principles and teachings of the present invention, the new and improved device or implement of the present invention may comprise, for example, a tape or plastic sheet or strip component, or alternatively, a batten strip, a batten bar, or the like, which comprise conventional devices or implements used in connection with securing environmental membranes to underlying roof decking insulation slabs or panels. Still yet further, the devices or implements have their seam plates or membrane plates fixedly mounted thereon at predeterminedly different spaced locations so as to correspond to the different transverse or lateral center-to-center spacing defined between adjacent crest portions of underlying corrugated metal roof decking substructures, or at predeterminedly spaced center-to-center positions, such that when the seams plates or membrane plates are secured to any of the underlying roof decking substructures, the environmental membranes will be securely fixed to the underlying roof decking substructures so as to operationally withstand environmental conditions, particularly, for example, uplifting wind forces.

BRIEF DESCRIPTION OF THE DRAWINGS

Various other objects, features, and attendant advantages of the present invention will be more fully appreciated from the following detailed description when considered in connection with the accompanying drawings in which like reference characters designate like or corresponding parts throughout the several views, and wherein.

DETAILED DESCRIPTION OF THE PREFERRED EMBODIMENT

Figure 1:
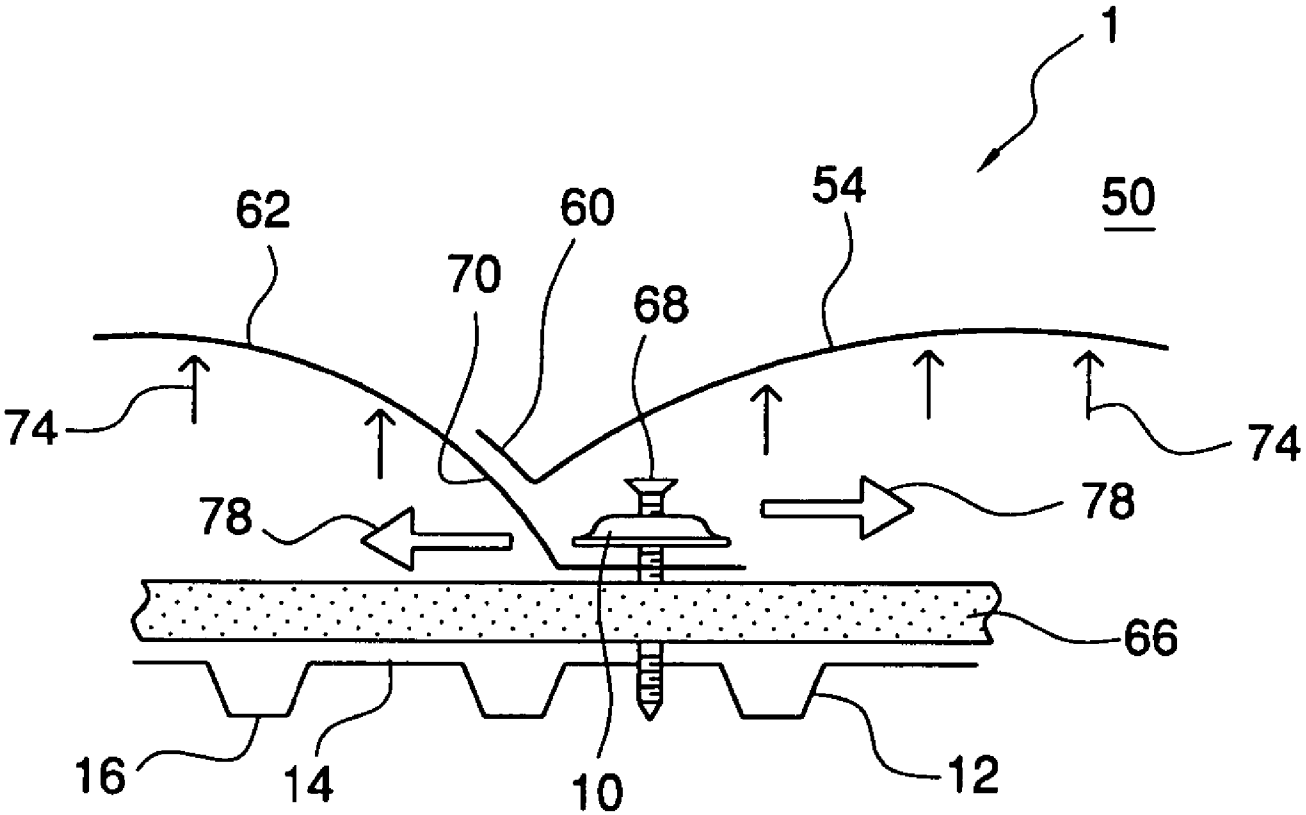
FIG. 1 (PRIOR ART)
FIG. 1 is a cross-sectional view of a conventional PRIOR ART roof decking assembly comprising a roof decking substructure, an insulation slab or panel mounted atop the roof decking substructure, and a pair of environmental membranes which are adapted to be fixedly secured atop the insulation slab or panel by means of a seam plate or membrane plate which is fixedly secured to the insulation slab or panel by means of a bolt fastener which is adapted to be threadedly engaged within a crest portion of the underlying roof decking substructure.
Figure 2:
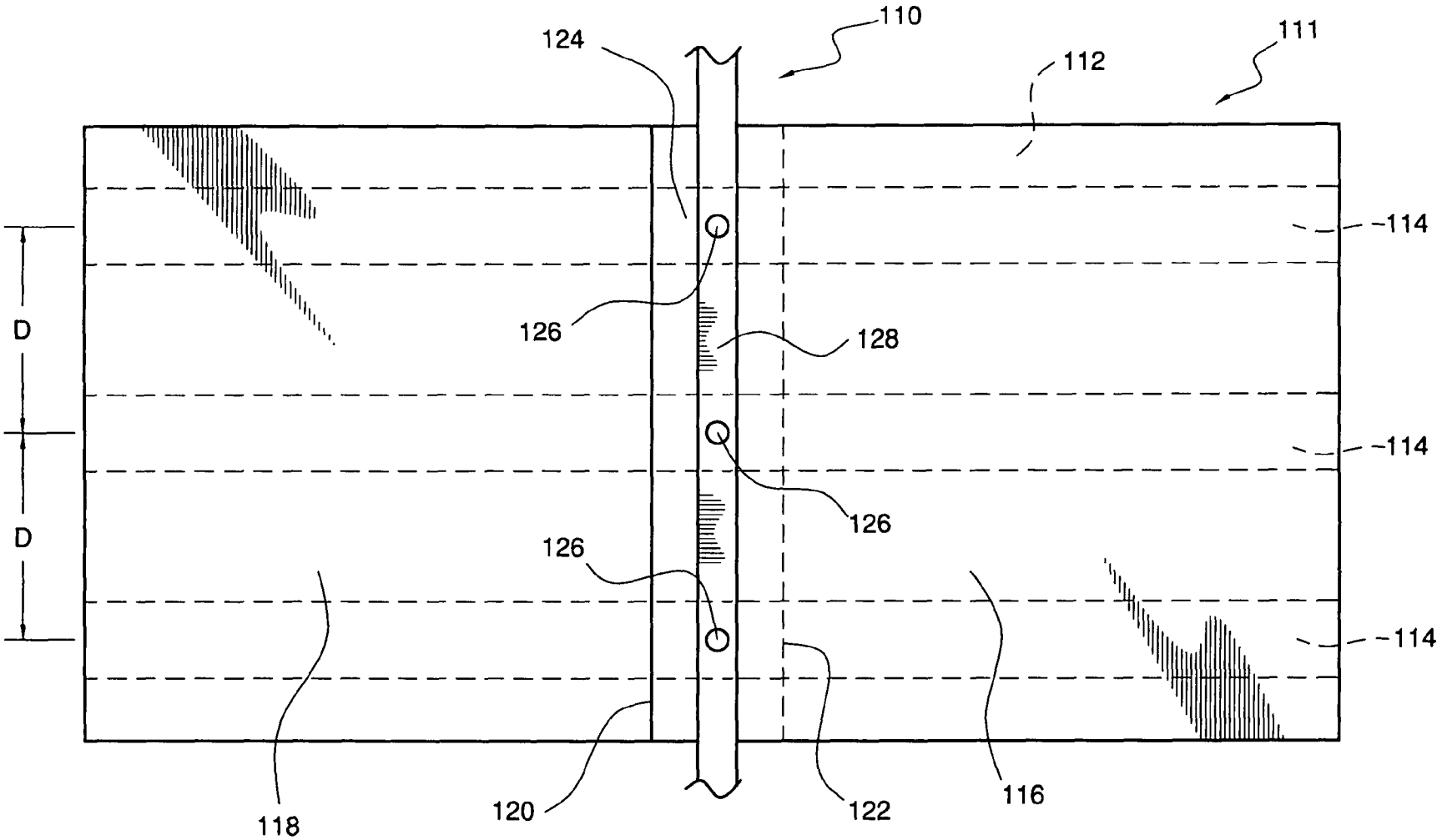
FIG. 2 is a top plan view of a first embodiment of a new and improved substrate implement, constructed in accordance with the principles and teachings of the present invention, as being utilized in conjunction with a corrugated metal roof decking substructure so as to form a first embodiment of a corrugated metal roof decking assembly for enabling the seam plates or membrane plates thereof to be properly aligned or positioned with respect to the crest portions of the underlying corrugated metal roofing decking substructure whereby the seam plates or membrane plates can in fact be fixedly secured to the crest portions of the underlying corrugated metal roof decking substructure so as to, in turn, maintain the environmental membranes fixedly secured atop the insulation slabs or panels of the corrugated metal roof decking assembly despite environmental conditions.

Referring now to the drawings, and more particularly to FIG. 2 thereof, a first embodiment of a new and improved seam plate or membrane plate and substrate assembly, which is constructed in accordance with the principles and teachings of the present invention, is disclosed and is generally indicated by the reference character 110. In addition, the new and improved seam plate or membrane plate substrate assembly 110 of the present invention is adapted to be used in conjunction with a corrugated metal roof decking components so as to effectively form a first embodiment of a new and improved corrugated metal roof decking assembly 111. More particularly, it is seen that the new and improved corrugated metal roof decking assembly 111 comprises an underlying corrugated metal roof decking substructure 112 which is similar to the roof decking substructure 12 of the aforenoted Hulsey patent and is therefore seen to comprise a plurality of transversely spaced crest portions 114. The underlying roof decking substructure 112 has an insulation panel or slab, not shown but similar to the insulation slab or panel 66 of the aforenoted Hulsey patent, disposed thereon, and a plurality of environmental or weather-protection membranes 116,118 are disposed atop the insulation slab or panel so as to protect the same from environmental or weather conditions. Respective edge portions 120,122 of adjacent membranes 116,118 are adapted to be overlapped with respect to each other so as to define a membrane seam region 124, and as is conventional in the art, a plurality of membrane plates or seam plates 126, similar to the seam plates or membrane plates 10 of the aforenoted Hulsey patent, are adapted to fixedly secure the seamed edge portions 120,122 of the membranes 116,118 to the crest portions 114 of the underlying corrugated metal roof decking substructure 112.

In accordance with the particularly unique and novel feature characteristic of the present invention, the new and improved seam plate or membrane plate substrate assembly 110 comprises a support strip or substrate 128 upon which the plurality of seam plates or membrane plates 126 are fixedly mounted by any suitable means, such as, for example, a suitable adhesive, or by alternative means, as will be more fully disclosed hereinafter. In view of the fact that it is known in the building industry that the construction of the underlying corrugated metal roof decking substructures 112 is such that the crest portions 114 thereof are transversely spaced from each other by means of predetermined center-to-center distances D which may comprise, for example, three inches (b 3.00") six inches (6.00"), or twelve inches (12"), the plurality of membrane plates or seam plates 126 are fixedly secured upon the support strip or substrate 128 at predetermined transversely spaced distances of between three inches (3.00") and twenty-four inches (24.00"), depending upon particular installation requirements, such as, for example, the environmental conditions prevailing at the particular site and to which the roof decking assembly will be operationally exposed.

In this manner, the transversely spaced positional placement of the plurality of membrane plates or seam plates 126 upon the support strip or substrate 128 matches or corresponds to the transverse spacing defined between the crest portions 114 of the particular underlying corrugated metal roof decking substructure 112 onto which the membranes 116, 118 are being secured. Alternatively, depending, for example, upon the particular environmental requirements for securing the environmental membranes 116,118 to the underlying corrugated metal roof decking assembly 111, that is, to ensure the maintenance of the environmental membranes 116,118 to the underlying corrugated metal roof decking assembly 111 under uplifting wind forces, the seam plates or membrane plates 126 may only need to be fixedly secured to alternative ones of the crest portions 114 of the underlying corrugated metal roof decking substructure 112. Accordingly, the seam plates or membrane plates 126 need not be secured to the support strip or substrate 128 at each position spaced three inches (3.00") or six inches (6.00") apart, but may alternatively be secured at, for example, positions which are spaced six inches (6.00"), twelve inches (12.00"), eighteen inches (18.00"), or twenty-four inches (24.00") apart.

It can thus be readily appreciated that as a result of the aforenoted structure of the new and improved seam plate or membrane plate implement assembly 110, and in particular, in view of the particular or predetermined transverse spacing of the plurality of membrane plates or seam plates 126 upon the support strip or substrate 128, which effectively matches or corresponds to the predetermined transverse spacing defined between adjacent ones of the crest portions 114 of the underlying corrugated metal roof decking substructure 112, then once a first or leading one of the seam plates or membrane plates 126 is aligned with and fixed within a particular one of the crest portions 114 of the underlying corrugated metal roof decking substructure 112, the other or remaining ones of the seam plates or membrane plates 126 will be inherently aligned with their respective ones of the crest portions 114 of the underlying corrugated metal roof decking substructure 112. Accordingly, when all of the seam plates or membrane plates 126 are to be fixedly secured to the crest portions 114 of the underlying corrugated metal roof decking substructure 112 by means of suitable threaded fasteners, not shown, proper fixation of the seam plates or membrane plates 126 to the crest portions 114 of the underlying corrugated metal roof decking substructure 112 is inherently or automatically ensured.

Figure 3:
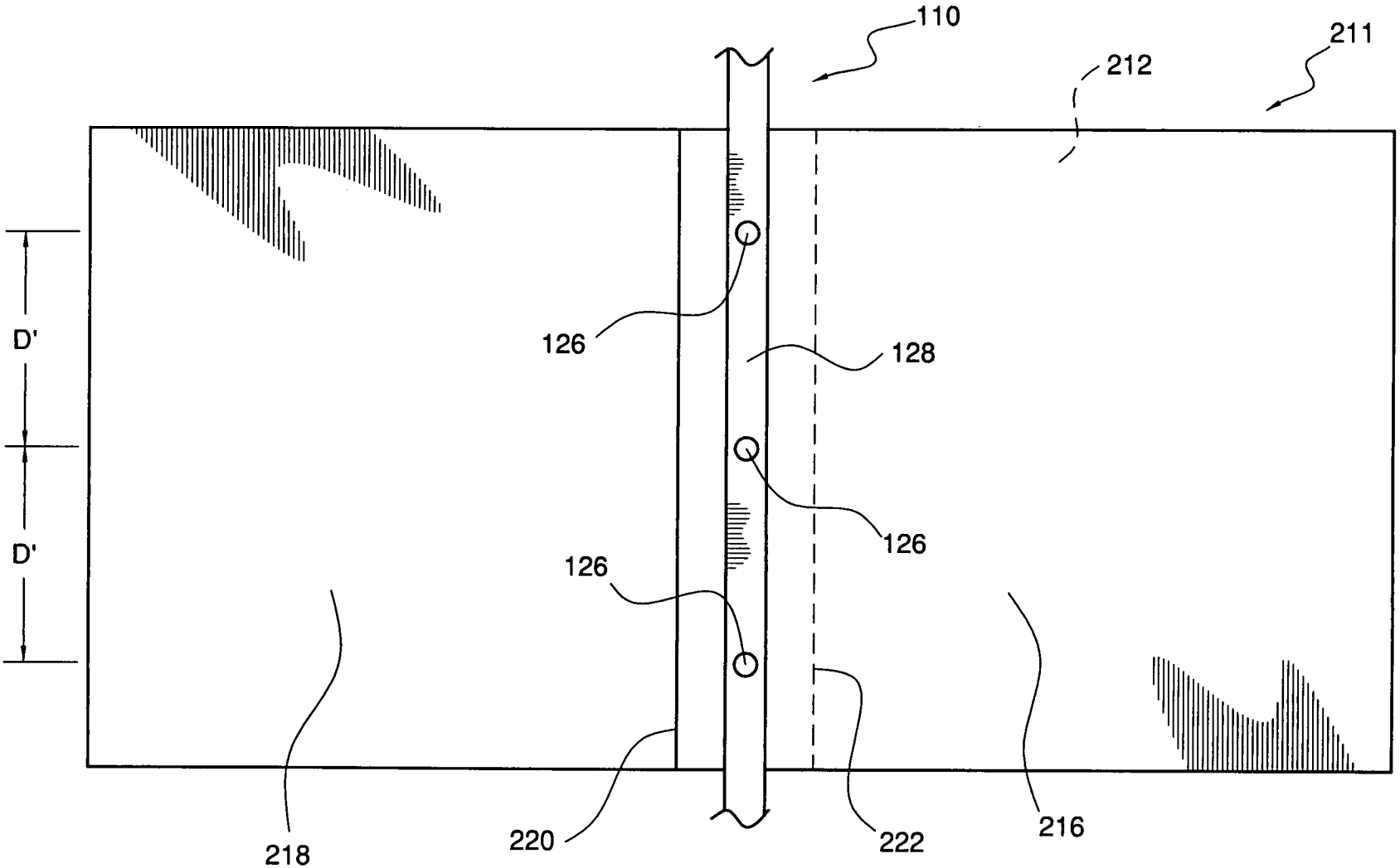
FIG. 3 is a top plan view of a second embodiment of a new and improved non-corrugated concrete or wood roof decking assembly showing the first embodiment of the new and improved substrate implement, constructed in accordance with the principles and teachings of the present invention, as being utilized in conjunction with a non-corrugated concrete or wood roof decking substructure for enabling the seam plates or membrane plates thereof to be properly aligned or positioned with predetermined positions of the underlying non-corrugated concrete or wood roofing deck substructure whereby the seam plates or membrane plates can in fact be fixedly secured at predetermined positions of the underlying non-corrugated concrete or wood roof decking substructure so as to, in turn, maintain the environmental membranes fixedly secured atop the insulation slabs or panels of the non-corrugated concrete or wood decking substructure despite environmental conditions.

With reference now being made to FIG. 3, the new and improved seam plate or membrane plate and substrate assembly 110, which has been constructed in accordance with the principles and teachings of the present invention, can likewise be utilized in conjunction with, for example, a non-corrugated concrete or wood roof decking components so as to effectively form a second embodiment of a new and improved non-corrugated concrete or wood roof decking assembly 211. It is to be noted that in view of the similarities between the first and second embodiments of the new and improved corrugated, metal and non-corrugated concrete or wood roof decking assemblies 111,211, components of the non-corrugated concrete or wood roof decking assembly 211 which correspond to those components of the corrugated metal roof decking assembly 111 have been designated by means of corresponding reference characters except that the reference characters will be within the 200 series. More particularly, it is seen that the new and improved non-corrugated concrete or wood roof decking assembly 211 comprises an underlying non-corrugated concrete or wood roof decking substructure 212 which is similar to the corrugated metal roof decking substructure 112 of the first embodiment of the corrugated metal roof decking assembly 111 as disclosed within FIG. 2 except that the non-corrugated concrete or wood roof decking substructure 212 does not comprise any transversely spaced crest portions. Nevertheless, the underlying roof decking substructure 212 has an insulation panel or slab, not shown, but, again, similar to the insulation slab or panel 66 of the aforenoted Hulsey patent, disposed thereon, and a plurality of environmental or weather-protection membranes 216, 218 are disposed atop the insulation slab or panel so as to protect the same from environmental or weather conditions. Respective edge portions 220,222 of adjacent membranes 216, 218 are adapted to be overlapped with respect to each other so as to define a membrane seam region 224, and as is conventional in the art, a plurality of membrane plates or seam plates, comprising, for example, seam plates or membrane plates similar or identical to the seam plates or membrane plates 126 of the first embodiment of the corrugated metal roof decking assembly 111 as disclosed within FIG. 2, as well as the seam plates 10 of the aforenoted Hulsey patent, are adapted to fixedly secure the seamed edge portions 220, 222 of the membranes 216,218 to the underlying non-corrugated concrete or wood roof decking substructure 212.

In accordance with the particularly unique and novel feature characteristic of the present invention, the new and improved seam plate or membrane plate substrate assembly 210 also comprises the support strip or substrate 128 upon which the plurality of seam plates or membrane plates 126 are fixedly mounted by any suitable means, such as, for example, a suitable adhesive, or by alternative means, as will be more fully disclosed hereinafter. In view of the fact that it is known in the building industry that in order to achieve a viable roof decking assembly 211 wherein the environmental membranes 216,218 must be secured to the underlying non-corrugated concrete or wood roof decking substructures 212 at predeterminedly spaced positions such that the environmental membranes 216,218 will be maintained secured to the underlying non-corrugated concrete or wood roof decking substructures 212 despite the presence or existence of significant uplifting wind forces, then the plurality of membrane plates or seam plates 126 are fixedly secured upon the support strip or substrate 128 at predetermined transversely spaced distances D' of between three inches (3.00") and twenty-four inches (24.00") depending upon the particular installation requirements, that is, for example, the environmental conditions prevailing at the particular site and to which the roof decking assembly 211 will be operationally exposed.

In this manner, the transversely spaced positional placement of the plurality of membrane plates or seam plates 126 upon the support strip or substrate 128 matches or corresponds to the predetermined transverse spacing defining those locations at which the environmental membranes 216, 218 are in fact to be secured to the particular underlying non-corrugated concrete or wood roof decking substructure 212. Accordingly, depending, for example, upon the particular environmental requirements for securing the environmental membranes 216,218 to the underlying non-corrugated concrete or wood roof decking assembly 211, that is, to ensure the secured fixation of the environmental membranes 216,218 to the underlying non-corrugated concrete or wood roof decking assembly 211 under uplifting wind forces, the seam plates or membrane plates 126 may only need to be fixedly secured, for example, at positions which are spaced six inches (6.00"), twelve inches (12.00"), eighteen inches (18.00"), or twentyfour inches (24.00") apart. In accordance with further structural features characteristic of the new and improved seam plate or membrane plate implement assembly 110 as constructed in accordance with the principles and teachings of the present invention, it is noted that while the substrate 128 upon which the plurality of seam plates or membrane plates 126 have been fixedly secured has been described as a support strip, the substrate can alternatively comprise other types of substrates and still satisfactorily perform or satisfy the operational objectives of the present invention. For example, in lieu of a strip-type substrate comprising a single ply of plastic material, the substrate can comprise, or be fabricated from, a suitable paper, film, fabric, metal wire, or metal sheet, or still further, the substrate can comprise a batten bar or a batten strip. When the substrate 128 is fabricated from thermoplastic material, the actual material may comprise various structural materials, such as, for example, oriented polypropylene (OPP), low-density polyethylene (LDPE), high-density polyethylene (HDPE), or linear low-density polyethylene (LLDPE).

Figure 4:
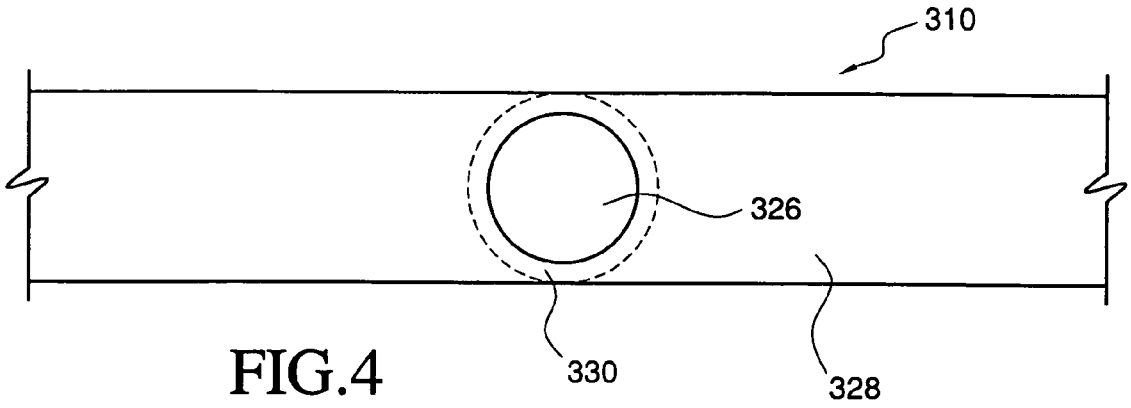
FIG. 4 is a top plan view showing a second embodiment of a new and improved tubular substrate implement, constructed in accordance with the principles and teachings of the present invention, upon which the plurality of seam plates or membrane plates are fixedly secured.
Figure 5:
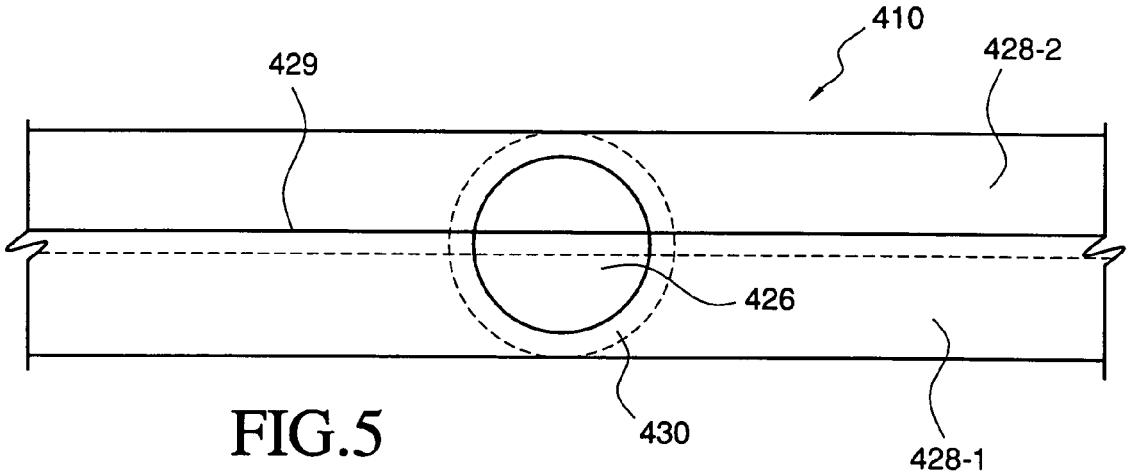
FIG. 5 is a top plan view showing a third embodiment of a new and improved substrate implement fabricated from seamed strip components, constructed in accordance with the principles and teachings of the present invention, upon which the plurality of seam plates or membrane plates are fixedly secured.

Still yet further, as disclosed, for example, in FIG. 4, the seam plate or membrane plate implement assembly, generally indicated by the reference character 310, can comprise a dual-ply tubular substrate 328 which is in the form of a single flattened strip, which is fabricated from a suitable thermoplastic film or sheet material, and which has a plurality of seam plates or membrane plates 326 fixedly secured thereon by means of, for example, a suitable annular or peripheral heat-sealed region 330. Alternatively still further, as disclosed, for example, within FIG. 5, the seam plate or membrane plate implement assembly, generally indicated by the reference character 410, can comprise a plurality of substrates 428-1,428-1, which may be in the form of single or dual-ply flattened strips, which are fabricated from suitable thermoplastic film or sheet materials, which are secured together at a longitudinally oriented seamed region 429, and which have a plurality of seam plates or membrane plates 426 fixedly secured thereon by means of, for example, a suitable annular or peripheral heat-sealed region 430. It is noted that in conjunction with the disclosures of the seam plate or membrane plate implement assemblies 310, 410, component parts thereof, which correspond to the component parts of the seam plate or membrane plate implement assembly 110, have been denoted by means of similar reference characters except that such corresponding or similar reference characters are within the 300 and 400 series, respectively. As can readily be appreciated still further from any one of the FIGS. 2-5, any one of the substrates 128,328, 428-1,428-2 preferably has a predetermined first transverse dimension which is defined between oppositely disposed side edge portions thereof, and each one of the plurality of seam plates 126,326,426 has a second transverse dimension which is not greater than the first transverse dimension of the respective substrate 128,328,428-1, 428-2 so as to be fixedly mounted upon the respective one of the substrates 128,328, 428-1,428-2 in such a manner that the plurality of seam plates 126,326,426 are disposed transversely inwardly between the oppositely disposed side edge portions of the respective substrate 128,328,428-1,428-2.

It is noted still further, in accordance with a critically important feature of the present invention, that it is desired that the seam plate or membrane plate implement assemblies 110,310,410 be readily portable, be capable of being stored, and be capable of being easily transported so as to be useable at different job sites. Accordingly, it is also desirable that the seam plate or membrane plate implement assemblies 110, 310,410 have a requisite amount of flexibility so as to be capable of being formed or packaged, for example, into a coiled structure such as, for example, the coiled structure disclosed within U.S. Pat. No. 5,711,116 which issued to Hasan on Jan. 27, 1998, or the similarly coiled structure disclosed within U.S. Pat. No. 5,469,671 which issued to Rathgeber et al. on Nov. 28, 1995. In accordance with the disclosures of such patents, the assemblies 110,310,410 can, for example, be fabricated from suitable plastic materials. As can therefore be readily appreciated, as a result of fabricating the seam plate or membrane plate implement assemblies 110, 310,410 in a coiled format, the seam plate or membrane plate implement assemblies 110,310,410 may be easily transported to a particular job site, uncoiled from its stored coil mode, and effectively dispensed over a roof decking assembly, as needed, in order to fixedly secure the seam plates or membrane plates 126,326,426, and the underlying environmental membranes 116,118,216,218, to the crest portions 114 of the underlying corrugated metal roof decking substructure 112, or alternatively, to the underlying non-corrugated concrete or wood decking substructures 212, respectively.

Figure 6:
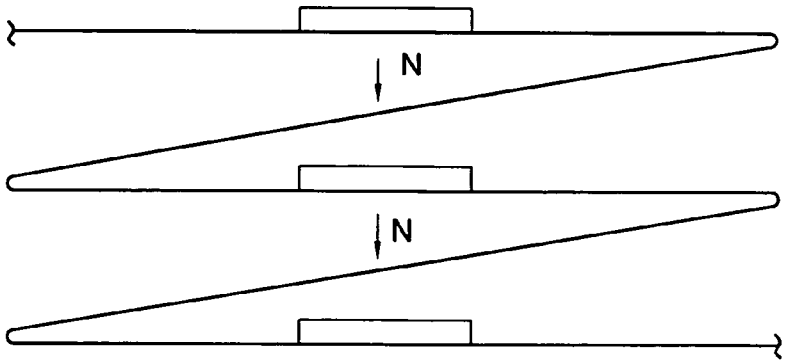
FIG. 6 is a side elevational view of the new and improved substrate implement as disclosed, for example, in FIG. 4, wherein the plurality of seam plates or membrane plates, fixedly secured upon the substrate strip, are disposed in a nested mode with respect to each other so as to be conveniently packaged for subsequent use by installation personnel at a particular roof decking job site.

With reference now being made to FIG. 6, in lieu of the packaging of the seam plate or membrane plate implement assemblies 110,310,410 as coiled structures in accordance with the aforenoted Hasan and Rathgeber et al. patents, any one of the seam plate or membrane plate implement assemblies 110,310,410 may be packaged in such a manner that the seam plates or membrane plates 126,326,426 may be disposed in a stacked nested array, as denoted by means of the arrows N, with the substrates 128,328, or 428-1,428-1 being folded over upon themselves in pleated arrays. Again, the fabrication and packaging of the seam plate or membrane plate implement assemblies 110,310,410 in such a nested format permits the seam plate or membrane plate implement assemblies 110,310,410 to be disposed, for example, within suitable packaging cartons which may subsequently be transported to a particular job site, unpacked from its stored nested mode, and effectively dispensed over a roof decking assembly, as needed, in order to fixedly secure the seam plates or membrane plates 126,326,426, and the underlying environmental membranes 116,118,216,218, to the crest portions 114 of the underlying corrugated metal roof decking substructure 112, or alternatively, to the underlying non-corrugated concrete or wood decking substructures 212, respectively.

Figure 7:
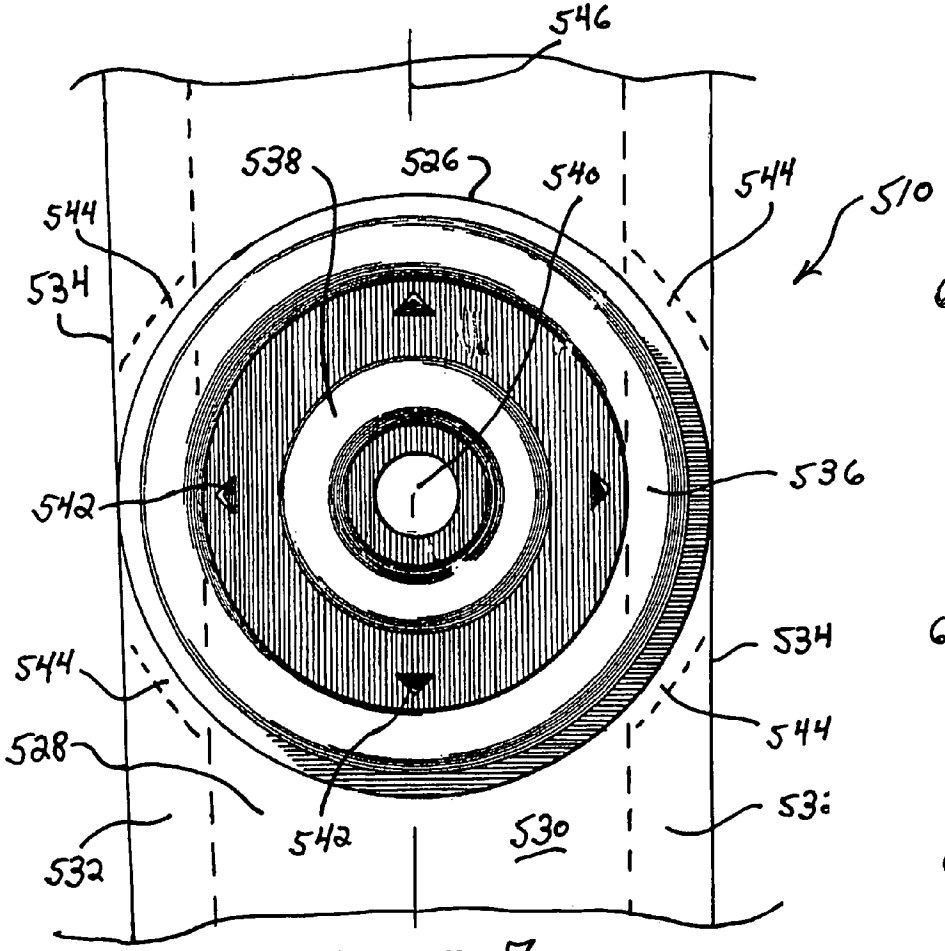
FIG. 7 is a top plan view showing a fourth embodiment of a new and improved substrate implement, constructed in accordance with the principles and teachings of the present invention so as to effectively comprise a C-shaped, folded implement upon which the plurality of seam plates or membrane plates are fixedly secured.

With reference now being made to FIG. 7, a fourth embodiment of a new and improved seam plate or membrane plate and substrate assembly, which has also been constructed in accordance with the principles and teachings of the present invention, is disclosed and is generally indicated by the reference character 510. It is to be noted that component parts of the fourth embodiment seam plate or membrane plate and substrate assembly 510 which correspond to similar component parts of the previously described seam plate or membrane plate and substrate assemblies 110,310,410 will be designated by similar reference characters except that they will be within the 500 series. More particularly, the seam plate or membrane plate and substrate assembly 510 comprises, for example, a single-ply substrate member 528 which is fabricated from a suitable thermoplastic film or sheet material and which is adapted to have a plurality of seam plates or membrane plates 526 fixedly secured thereon, although only one of the seam plates or membrane plates 526 is illustrated. The substrate member 528 is adapted to be folded in accordance with a particular mode or manner so as to have a substantially C-shaped configuration comprising an upper planar member 530 disposed atop the plurality of seam plates or membrane plates 526, and a pair of lower planar flap-type members 532,532 which are folded inwardly beneath the upper planar member 530 along the longitudinally extending, oppositely disposed side edge portions 534,534 of the substrate member 528.

Each one of the seam plates or membrane plates 526 may be similar to the seam plate or membrane plate as disclosed within the aforenoted patent to Murphy, and it is therefore noted that each one of the seam plates or membrane plates 526 comprises a radially outer annular rib member 536, a radially inner annular rib member 538, and a central aperture 540 through which a deck assembly fastener, not shown, is adapted to be inserted. A plurality of downwardly projecting tangs or barbs 542 are formed upon the seam plate or membrane plate 526 so as to be disposed within an annular array which is interposed between the radially outer and radially inner rib members 536,538. Accordingly, it can be seen that when the pair of lower planar flap-type members 532,532 are formed, folded under the upper planar member 530, and heat sealed to the upper planar member 530 by means of circumferentially spaced, arcuately configured heat-sealed regions 544, it is appreciated that the downwardly projecting barbs or tangs 542 will be freely exposed so as to engage the overlapping seamed edge regions 120,122 or 220, 222 of the environmental membranes 116,118,216,218. In addition, it is noted that the formation of the underlying flap-type members 532,532 as extending only partially beneath the upper planar member 530 and each one of the seam plates or membrane plates 526 permits a reduction, and a consequent cost savings, in the amount of material required to form the substrate member 528. Alternatively, the underlying flap-type members 532, 532 may extend further toward each other than is actually illustrated, and may even extend completely beneath the seam plates or membrane plates 526 so as to meet each other along a centrally located longitudinally extending locus 546. In these instances, some or all of the barbs or tangs 542 may be exposed or covered, and still further, the arcuately configured heat-sealed regions 544 may together define, in effect, a pair of semi-circular heat-sealed regions. Still further, if the underlying flap members 532, 532 cover any or all of the downwardly projecting barbs or tangs 542, the barbs or tangs 542 will of course pierce the underlying flap members 532,532 when each seam plate or membrane plate 526 is affixed to the underlying roof decking by means of the fastener passed through the central aperture 540. It is of course to be appreciated still further that the seam plate or membrane plate 526 may not be provided with any barbs or tangs 542, or alternatively, in lieu of such barbs or tangs 542 which would tend to pierce the underlying flap members 532,532, the seam plate or membrane plate 526 may simply be provided with projections which have rounded portions which would tend to grip environmental membranes similar to the environmental membranes 116,118,216, 218.

Figure 8:
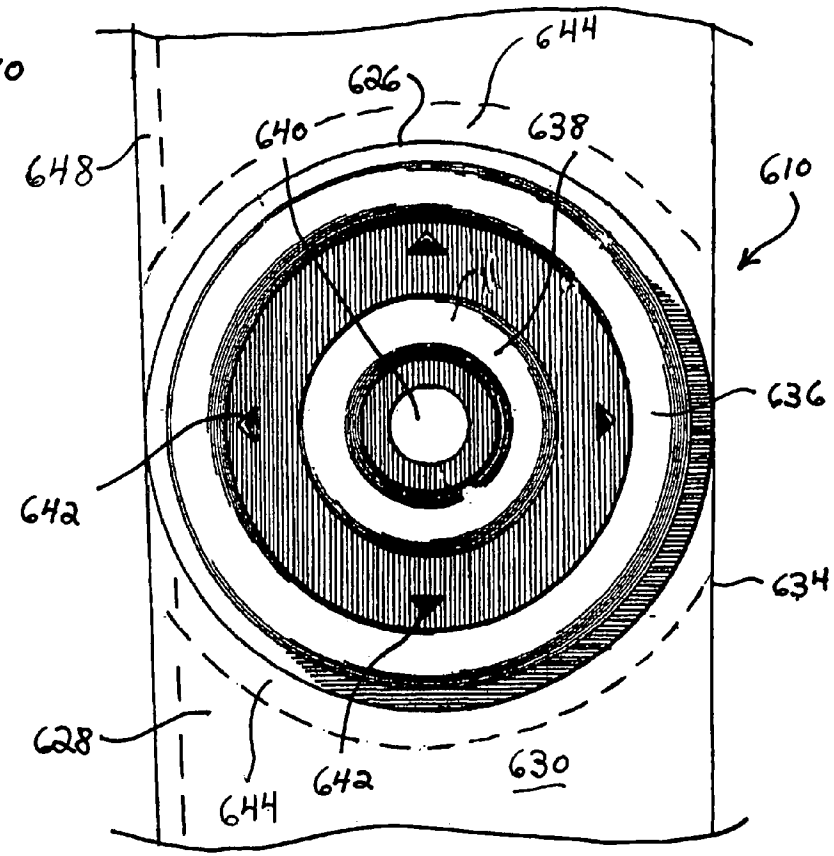
FIG. 8 is a top plan view showing a fifth embodbodiment of a new and improved substrate implement, constructed in accordance with the principles and teachings of the present invention so as to effectively comprise an implement which is folded over upon itself in a substantially V-shaped manner and upon which the plurality of seam plates or membrane plates are fixedly secured.

With reference now being made to FIG. 8, a fifth embodiment of a new and improved seam plate or membrane plate and substrate assembly, which has also been constructed in accordance with the principles and teachings of the present invention, is disclosed and is generally indicated by the reference character 610. It is to be noted that component parts of the fifth embodiment seam plate or membrane plate and substrate assembly 610 which correspond to similar component parts of the previously described seam plate or membrane plate and substrate assemblies 110,310,410,510 will be designated by similar reference characters except that they will be within the 600 series. In addition, in the interest of brevity, only those differences between the fifth embodiment seam plate or membrane plate and substrate assembly 610, as compared to the previously described seam plate or membrane plate and substrate assemblies 110,310,410,510, will be described. More particularly, the seam plate or membrane plate and substrate assembly 610 comprises, for example, a single-ply substrate member 628 which is fabricated from a suitable thermoplastic film or sheet material and which is adapted to have a plurality of seam plates or membrane plates 626 fixedly secured thereon, although only one of the seam plates or membrane plates 626 is illustrated. The substrate member 628 is adapted to be folded in accordance with a particular mode or manner so as to have a substantially V-shaped configuration comprising an upper planar ply member 630 disposed atop the plurality of seam plates or membrane plates 626, and a lower planar ply member, not visible, which is folded inwardly beneath the upper planar ply member 630 along, for example, the longitudinally extending, edge portion 634 of the substrate member 628.

Accordingly, the upper and lower ply members have substantially equal width dimensions. In addition, it is seen that a pair of semi-circular heat-sealed regions 644 are formed around the outer periphery of the seam plate or membrane plate 626 so as to heat-seal the upper and lower ply members of the substrate member 628 together, and still further, the free edge portions of the upper and lower ply members of the substrate member 628 may likewise be heat-sealed together along a longitudinally extending seam portion 648. In view of the fact that the lower ply member of the substrate member 628 extends entirely beneath each one of the seam plates or membrane plates 626, and as was the case with the seam plate or membrane plate and substrate assembly 510, when each seam plate or membrane plate 626 is affixed to the underlying decking by means of the fastener passed through its central aperture 640, the downwardly projecting barbs or tangs 642 will of course pierce the underlying flap member so as to engage the underlying environmental membranes similar to membranes 116,118,216,218. It is of course to be appreciated that, as has been previously noted, if the seam plate or membrane plate 626 is not provided with barbs or tangs 642, or if in lieu of the barbs or tangs 642, the seam plate or membrane plate 626 is provided with downwardly extending projections having rounded ends, then the underlying flap member will not be pierced. Still further, it is likewise noted that in lieu of the seam plate or membrane plate being circular, the same may have other geometrical configurations whereby the heat-sealed regions would not be semi-circular in shape but would simply extend around the outer peripheral edge portion of the plate.

Figure 9:
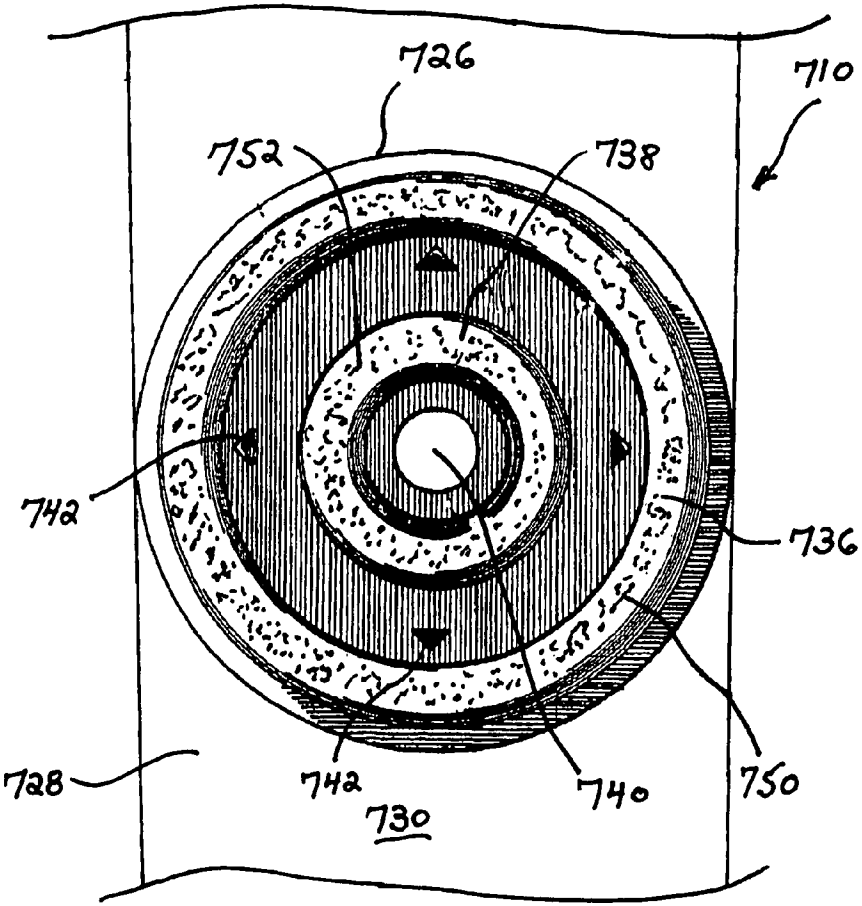
FIG. 9 is a top plan view showing a sixth embodiment of a new and improved substrate implement, constructed in accordance with the principles and teachings of the present invention, wherein the plurality of seam plates or membrane plates are fixedly secured to the implement by gluing.

With reference now being made to FIG. 9, a sixth embodiment of a new and improved seam plate or membrane plate and substrate assembly, which has also been constructed in accordance with the principles and teachings of the present invention, is disclosed and is generally indicated by the reference character 710. It is to be noted that component parts of the sixth embodiment seam plate or membrane plate and substrate assembly 710 which correspond to similar component parts of the previously described seam plate or membrane plate and substrate assemblies 110,310,410,510,610 will be designated by similar reference characters except that they will be within the 700 series. In addition, in the interest of brevity, only those differences between the sixth embodiment seam plate or membrane plate and substrate assembly 710, as compared to the previously described seam plate or membrane plate and substrate assemblies 110,310, 410,510, 610, will be described.

More particularly, in accordance with the structural features characteristic of the sixth embodiment seam plate or membrane plate and substrate assembly 710, a single ply substrate member 728, which is fabricated from a suitable thermoplastic film or sheet material, is adapted to have a plurality of seam plates or membrane plates 726 fixedly secured thereon, although only one of the seam plates or membrane plates 726 is illustrated. In particular, the single-ply substrate member 728 is adapted to be secured to each one of the seam plates or membrane plates 726 along the upper ridge or crest portions of the radially outer and radially inner rib members 736,738 by means of a suitable adhesive material 750,752. It is of course to be appreciated that if the seam plate or membrane plate 726 is not provided with rib members 736,738, the substrate member 728 may of course be simply secured to the upper planar surface region of the seam plate or membrane plate 726. Furthermore, in connection with the securing of the substrate member 728 to the seam plate or membrane plate 726, in lieu of utilizing separate adhesive materials defining adhesive bonds 750,752, the substrate member 728 may be heat-sealed directly to the upper surface regions of the seam plate or membrane plate 726.

Figure 10:
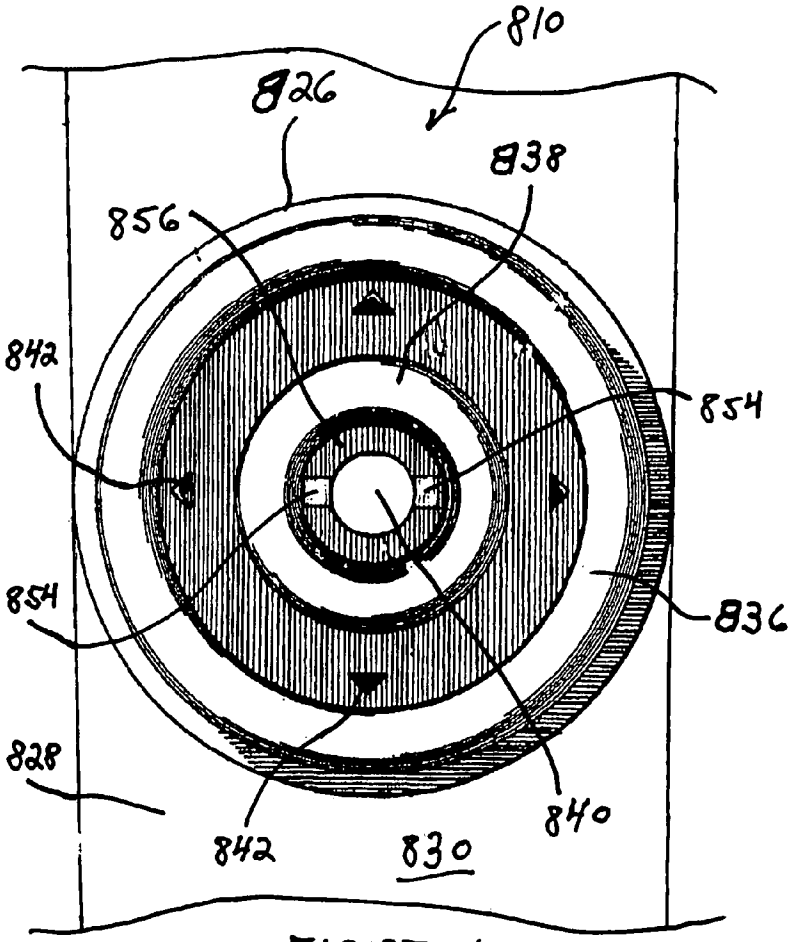
FIG. 10 is a top plan view showing a seventh embodiment of a new and improved substrate implement, constructed in accordance with the principles and teachings of the present invention, wherein the implement comprises a mesh-type fabric to which the plurality of seam plates or membrane plates are fixedly secured by folded prong members located at diametrically opposed central regions of each seam plate.

With reference now being made to FIG. 10, a seventh embodiment of a new and improved seam plate or membrane plate and substrate assembly, which has also been constructed in accordance with the principles and teachings of the present invention, is disclosed and is generally indicated by the reference character 810. It is to be noted that component parts of the seventh embodiment seam plate or membrane plate and substrate assembly 810 which correspond to similar component parts of the previously described seam plate or membrane plate and substrate assemblies 110,310, 410,510,610, 710 will be designated by similar reference characters except that they will be within the 800 series. In addition, in the interest of brevity, only those differences between the seventh embodiment seam plate or membrane plate and substrate assembly 810, as compared to the previously described seam plate or membrane plate and substrate assemblies 110,310, 410,510,610,710 will be described. More particularly, in accordance with the structural features characteristic of the seventh embodiment seam plate or membrane plate and substrate assembly 810, a single-ply substrate member 828, which is fabricated from a suitable mesh material, is adapted to have a plurality of seam plates or membrane plates 826 fixedly secured thereon, although only one of the seam plates or membrane plates 826 is illustrated.

In particular, the mesh material may, for example, be fabricated from polyester and/or may comprise either woven or non-woven structures. The substrate member 828 is adapted to be secured atop each one of the seam plates or membrane plates 826, and in order to form such composite structure whereby each one of the seam plates or membranes 826 can in fact be fixedly secured to the overlying substrate member 828, it is noted that each one of the seam plates or membrane plates 826 is provided with a pair of prong members 854,854 which initially or originally project upwardly from the upper surface portion of each seam plate or membrane plate 826 such that the prong members 854,854 can in effect pierce the mesh structure comprising the substrate member 828. The prong members 854,854 are disposed at diametrically opposite positions immediately adjacent to the central aperture 840 through which the seam plate or membrane plate securing fastener, not shown, is adapted to be passed, and after the prong members 854,854 extend through or pierce the substrate member 828, the prong members 854, 854 are folded radially outwardly and downwardly so as to effectively engage the upper surface ledge portion 856 of the seam plate or membrane plate 826 which is radially interposed between the central aperture 840 and the radially inner rib member 838. In this manner, the folded prong members 854,854 operatively cooperate with the ledge portion 856 so as to effectively entrap portions of the substrate member 828 therebetween. It is of course to be appreciated that in lieu of the substrate member 828 being disposed atop the seam plate or membrane plate 826, and in lieu of the prong members 854, 854 initially or originally projecting upwardly from the upper surface portion of each seam plate or membrane plate 826, the substrate member 828 can be disposed beneath the seam plate or membrane plate 826 and the prong members 854,854 can initially or originally project downwardly from the lower surface portions of the seam plate or membrane plate 826 so as to in effect pierce the mesh structure comprising the substrate member 828. Subsequently, the prong members 854, 854 are folded radially outwardly and upwardly so as to effectively engage a lower surface ledge portion of the seam plate or membrane plate 826 whereby the folded prong members 854,854 operatively cooperate with the ledge portion so as to effectively entrap portions of the substrate member 828 therebetween.

Figure 11:
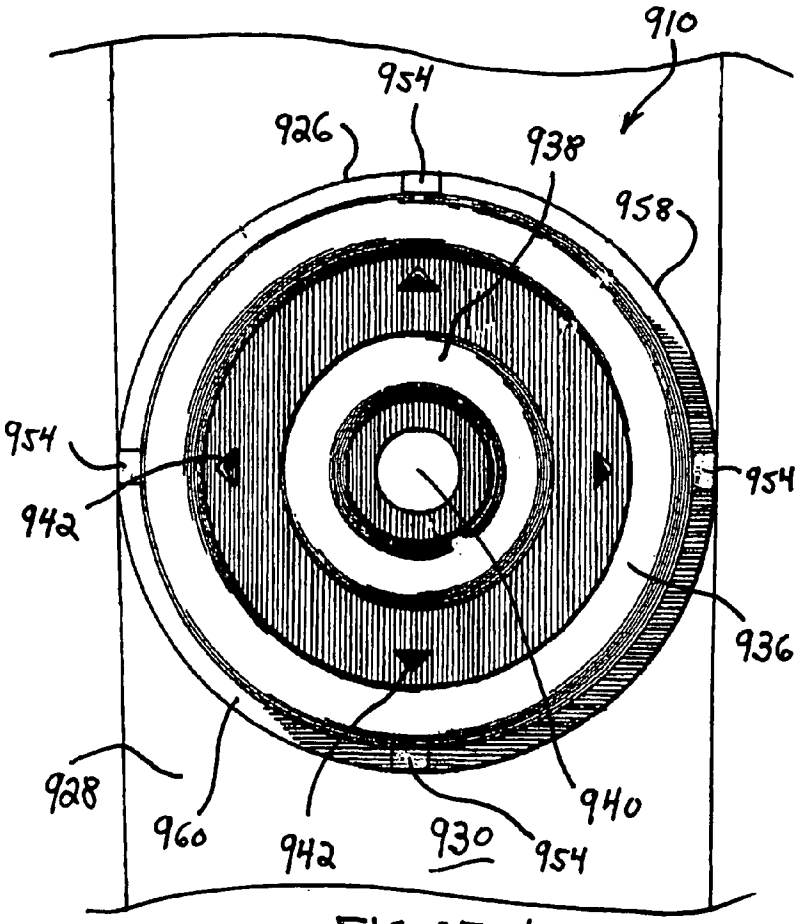
FIG. 11 is a top plan view showing an eighth embodiment of a new and improved substrate implement, constructed in accordance with the principles and teachings of the present invention, wherein the implement comprises a mesh-type fabric to which the plurality of seam plates or membrane plates are fixedly secured by folded prong members located at outer peripherally spaced regions of each seam plate.

Turning now to FIG. 11, an eighth embodiment of a new and improved seam plate or membrane plate and substrate assembly, which has also been constructed in accordance with the principles and teachings of the present invention, is disclosed and is generally indicated by the reference character 910. It is to be noted that component parts of the eighth embodiment seam plate or membrane plate and substrate assembly 910 which correspond to similar component parts of the previously described seam plate or membrane plate and substrate assemblies 110,310,410,510,610,710,810 will be designated by similar reference characters except that they will be within the 900 series. In addition, in the interest of brevity, only those differences between the eighth embodiment seam plate or membrane plate and substrate assembly 910, as compared to the previously described seam plate or membrane plate and substrate assemblies 110,310,410,510, 610, 710,810 will be described. More particularly, in accordance with the structural features characteristic of the eighth embodiment seam plate or membrane plate and substrate assembly 910, a single-ply substrate member 928, which is likewise fabricated from a suitable mesh material, is adapted to have a plurality of seam plates or membrane plates 926 fixedly secured thereon, although only one of the seam plates or membrane plates 926 is illustrated.

In particular, the mesh material may, for example, be fabricated from polyester and/or may comprise either woven or non-woven structures. The substrate member 928 is adapted to be secured atop each one of the seam plates or membrane plates 926, and in order to form such composite structure whereby each one of the seam plates or membranes 926 can in fact be fixedly secured to the overlying substrate member 928, it is noted that each one of the seam plates or membrane plates 926 is provided with a plurality of prong members 954 which initially or originally project upwardly from the upper surface portion of each seam plate or membrane plate 926 such that the prong members 954 can in effect pierce the mesh structure comprising the substrate member 928. The prong members 954 are disposed at positions which are circumferentially spaced 90° apart, and are integrally connected to outer peripheral edge portions 958 of the seam plate or membrane plate 926. Accordingly, after the prong members 954 extend through or pierce the substrate member 928, the prong members 954 are folded radially inwardly and downwardly so as to effectively engage the upper surface outer ledge portion 960 of the seam plate or membrane plate 926 which is radially interposed between the outer peripheral edge portion 958 and the radially outer annular rib member 936. In this manner, the folded prong members 954 operatively cooperate with the ledge portion 960 so as to effectively entrap upper surface portions of the substrate member 928 therebetween. As was the case with the embodiment illustrated within FIG. 10, the substrate member 928 can be disposed beneath the seam plate or membrane plate 926 and the prong members 954 can be located upon the underside portions of the seam plate or membrane plate 926 so as to be folded upwardly in order to effectively engage lower surface portions of the substrate member 928. Still further, while four prong members 954 have been illustrated as being located at angularly separated positions 90° apart, the seam plate or membrane plate may be provided with only two prong members spaced 180° apart.

Figure 12:
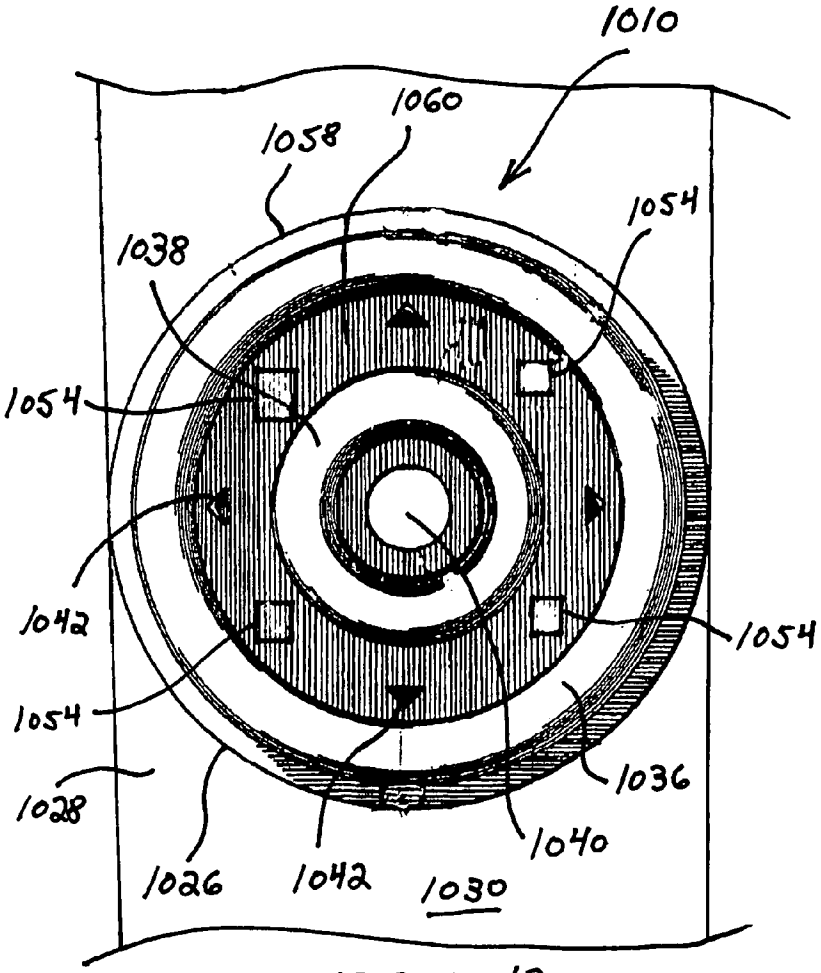
FIG. 12 is a top plan view showing a ninth embodiment of a new and improved substrate implement, constructed in accordance with the principles and teachings of the present invention, wherein the implement comprises a mesh-type fabric to which the plurality of seam plates or membrane plates are fixedly secured by folded prong members located at radial positions interposed between the central aperture and outer peripheral edge portion of each plate.

With reference lastly being made to FIG. 12, a ninth embodiment of a new and improved seam plate or membrane plate and substrate assembly, which has also been constructed in accordance with the principles and teachings of the present invention, is disclosed and is generally indicated by the reference character 1010. It is to be noted that component parts of the ninth embodiment seam plate or membrane plate and substrate assembly 1010 which correspond to similar component parts of the previously described seam plate or membrane plate and substrate assemblies 110,310, 410,510,610, 710,810,910 will be designated by similar reference characters except that they will be within the 1000 series. In addition, in the interest of brevity, only those differences between the eighth embodiment seam plate or membrane plate and substrate assembly 1010, as compared to the previously described seam plate or membrane plate and substrate assemblies 110,310,410,510,610,710,810,910 will be described. More particularly, in accordance with the structural features characteristic of the ninth embodiment seam plate or membrane plate and substrate assembly 1010, a single-ply substrate member 1028, which is fabricated from a suitable mesh material, is adapted to have a plurality of seam plates or membrane plates 1026 fixedly secured thereon, although only one of the seam plates or membrane plates 1026 is illustrated.

In particular, the mesh material may, for example, be fabricated from polyester and/or may comprise either woven or non-woven structures. The substrate member 1028 is adapted to be secured atop each one of the seam plates or membrane plates 1026, and in order to form such composite structure whereby each one of the seam plates or membranes 1026 can in fact be fixedly secured to the overlying substrate member 1028, it is noted that each one of the seam plates or membrane plates 1026 is provided with four prong members 1054 which initially or originally, for example, project upwardly from the upper surface portions of each seam plate or membrane plate 1026 which are located at radial positions interposed between the central aperture 1040 and the outer peripheral edge portion 1058 of the seam plate or membrane plate 1026. In this manner, the prong members 1054 can in effect pierce the mesh structure comprising the substrate member 1028, and accordingly, after the prong members 1054 extend through or pierce the substrate member 1028, the prong members 1054 are folded radially inwardly and downwardly so as to effectively engage the upper surface portion 1060 of the seam plate or membrane plate 1026 which is radially interposed between the outer peripheral edge portion 1058 and the central aperture 1040. Accordingly, the folded prong members 1054 operatively cooperate with the upper surface portion 1060 so as to effectively entrap upper surface portions of the substrate member 1028 therebetween. As has been previously noted, it is also possible for the substrate member 1028 to be disposed beneath the seam plate or membrane plate 1026 and for the prong members 1054 to be located upon the underside portions of the seam plate or membrane plate 1026 so as to be folded upwardly in order to effectively engage lower surface portions of the substrate member 1028. It is lastly noted that while the four prong members 1054 are disposed within the illustrated array so as to be disposed at circumferential positions which simulate, for example, the two o'clock, four o'clock, eight o'clock, and ten o'clock positions upon the face of a watch or clock, the prong members may be located at other symmetrical positions.

Thus, it may be seen that in accordance with the principles and teachings of the present invention, there has been provided a new and improved a seam plate or membrane plate implement assembly which comprises a support strip or substrate having a longitudinal extent and upon which a plurality of seam plates or membrane plates are fixedly disposed at predetermined uniformly spaced longitudinal positions which correspond to the transverse spacing defined between the crest portions of an underlying corrugated metal roof decking substructure, or alternatively, which correspond to the transverse spacing defined between predetermined positions at which the seam plates or membrane plates are desired to be secured to an underlying non-corrugated concrete or wood roof decking substructure. The substrate may have a requisite amount of flexibility so as to permit the same to be coiled or folded for storage and transportation purposes, and when the same is to be used at a particular job site, the substrate may be uncoiled or unfolded from its storage mode.

Subsequently, when, for example, the leading one of the seam plates or membrane plates, which is fixedly secured upon the strip or substrate, is positionally aligned with one of the crest portions of the underlying corrugated metal roof decking substructure, or is disposed at an initial position with respect to an underlying non-corrugated concrete or wood decking substructure, and still further, when the leading one of the seam plates or membrane plates is in fact fixedly secured to the underlying roof decking substructure as a result of one of the threaded fasteners being passed through such leading seam plate or membrane plate and threadedly engaged within the corresponding crest portion of the underlying corrugated metal roof decking substructure, or within the non-corrugated concrete or wood decking substructure, then the other seam plates or membrane plates are automatically or inherently positionally aligned with subsequent crest portions of the underlying corrugated metal roof decking substructure, or at predeterminedly desired positions with respect to the underlying non-corrugated concrete or wood decking substructure. In this manner, all of the seam plates or membrane plates are able to be securely fastened to the underlying roof decking substructures, by means of their respective fasteners, whereby the environmental membranes will be fixedly maintained in their overlying states upon the roof decking assembly insulation slabs or panels so as to thereby desirably protect the same despite wind uplifting forces.

Obviously, many variations and modifications of the present invention are possible in light of the above teachings. It is therefore to be understood that within the scope of the appended claims, the present invention may be practiced otherwise than as specifically described herein.

What is claimed as new and desired to be protected by Letters Patent of the United States of America, is:

1. An assembly for facilitating a fixed mounting of roof membrane seam plates at predetermined locations upon an underlying roof decking substructure by means of fasteners, comprising:

a substrate, comprising at least one ply, having a longitudinal extent and a predetermined first transverse dimension as defined between oppositely disposed side edge portions; and a plurality of seam plates comprising a first seam plate and remaining seam plates, for fixing environmental membranes upon an underlying roof decking substructure, said seam plates being affixed to said substrate independently of the fasteners and having second transverse dimensions which are not greater than said first transverse dimensions of said substrate so as to be fixedly mounted upon said at least one ply of said substrate in such a manner that said plurality of seam plates are disposed transversely inwardly between said oppositely disposed side edge portions of said substrate, and at predeterminedly spaced positions spaced along said longitudinal extent of said substrate, so as to define with said substrate an integral product entity such that when said first seam plate of said plurality of seam plates is fixedly secured at a first location along the underlying roof decking substructure by means of a fastener, the remaining seam plates of said plurality of seam plates, fixedly attached to said substrate at said predetermined positions spaced along said longitudinal extent of said substrate, will inherently be disposed at predetermined locations along the underlying roof decking substructure at which said seam plates are to be fixedly secured by the fasteners so as to ensure the proper fixation of said seam plates to the underlying roof decking substructure whereby, the fixation of the environmental membranes, upon the underlying roof decking substructure, will be ensured.

2. The assembly as set forth in claim 1, wherein:

when the underlying roof decking substructure comprises a corrugated roof decking substructure, comprising a plurality of crest portions spaced from each other by means of predetermined distances, said plurality of seam plates are fixedly mounted upon said substrate at predeterminedly spaced positions which correspond to the predetermined distances defined between the plurality of spaced crest portions of the underlying corrugated roof decking substructure so as to ensure said plurality of seam plates can be fixedly secured to the plurality of spaced crest portions of the underlying corrugated root decking substructure.

3. The assembly as set forth in claim 1, wherein:

when the underlying roof decking substructure comprises a non-corrugated roof decking substructure, said plurality of seam plates are fixedly mounted upon said substrate at predeterminedly spaced positions which will ensure the secure fixation of the environmental membranes to the underlying non-corrugated roof decking substructure in such a manner that the environmental membranes will exhibit uplifting wind force resistance so as to remain fixed to the underlying non-corrugated roof decking substructure despite being exposed to significant uplifting wind forces.

4. The assembly as set forth in claim 1, wherein:

each one of said plurality of seam plates has a plurality of projections extending downwardly from undersurface portions of each one of said plurality of seam plates for engaging each one of the environmental membranes and said substrate has a substantially C-shaped cross-sectional configuration comprising an upper planar member disposed atop said plurality of seam plates, and a pair of lower planar flap-type members folded inwardly from opposite side edge portions of said upper planar member.

5. The assembly as set forth in claim 4, further comprising:

heat-sealed regions defined around peripheral edge portions of each one of said plurality of seam plates for securing each one of said plurality of seam plates to said substrate.

6. The assembly as set forth in claim 4, wherein:

each one of said plurality of seam plates has a predetermined lateral extent, said upper planar member of said substrate has a lateral extent which is at least equal to said lateral extent of each one of said plurality of seam plates so as to cover upper surface portions of each one of said plurality of seam plates; and said flap-type members have lateral extents which are less than said predetermined lateral extent of each one of said plurality of seam plates such that when said flap-type members are folded beneath each one of said plurality of seam plates, said flap-type members will only partially cover undersurface portions of each one of said plurality of seam plates so as to enable at least some of said projections of said seam plates to freely engage the environmental membranes.

7. The assembly as set forth in claim 4, wherein:

each one of said plurality of seam plates has a predetermined lateral extent;

said upper planar member of said substrate has a lateral extent which is at least equal to said lateral extent of each one of said plurality of seam plates so as to cover upper surface portions of each one of said plurality of seam plates; and said flap-type members each have lateral extents which are approximately equal one-half of said lateral extent of said upper planar member of said substrate such that when said flap-type members are folded beneath each one of said plurality of seam plates, said flap-type members will substantially cover entire undersurface portions of each one of said plurality of seam plates wherein said projections of said seam plates will engage said folded flap-type members of said substrate when said plurality of seam plates are secured to the underlying roof decking substructure so as to also engage the environmental membranes.

8. The assembly as set forth in claim 1, wherein:

each one of said plurality of seam plates has a plurality of projections extending downwardly from undersurface portions of each one of said plurality of seam plates for engaging each one of the environmental membranes; and said substrate has a substantially V-shaped cross-sectional configuration comprising an upper planar member disposed atop said plurality of seam plates, and a lower planar member folded along a first side edge portion of said substrate so as to be disposed beneath said plurality of seam plates wherein said projections of said seam plates will engage said lower planar member of said substrate when said plurality of seam plates are secured to the underlying roof decking substructure so as to also engage the environmental membranes.

9. The assembly as set forth in claim 8, further comprising:

heat-seal regions defined around peripheral edge portions of each one of said plurality of seam plates for securing each one of said plurality of seam plates to said substrate.

10. The assembly as set forth in claim 8, further comprising:

a longitudinally-extending heat seal region defined along a second oppositely disposed side edge portion of said substrate so as to affix said upper and lower planar members of said substrate together.

11. The assembly as set forth in claim 1, further comprising:

adhesive means for adhesively bonding upper surface portions of each one of said plurality of seam plates to said substrate.

12. The assembly as set forth in claim 1, further comprising:

foldable prong means mounted upon each one of said plurality of seam plates for piercing said substrate and securing each one of said plurality of seam plates upon said substrate when said foldable prong means are folded into engagement with said substrate so as to effectively entrap portions of said substrate between said folded prong means and each one of said plurality of seam plates.

13. The assembly as set forth in claim 1, wherein:

said substrate comprises a structure selected from the group comprising a suitable tape, paper, film, fabric, metal wire, metal sheet, batten strip, and batten bar.

14. The assembly as set forth in claim 1, wherein:

said substrate comprises at least a pair of substrates fixedly connected together along at least one longitudinally extending seam portion.

15. The assembly as set forth in claim 1, wherein:

said substrate comprises a flattened tubular member; and said plurality of seam plates are fixedly secured within said tubular member by means of heat-sealed peripheral regions.

16. The assembly as set forth in claim 1, wherein:

said substrate is comprised of a suitable material that is flexible so as to permit said substrate to be rolled into a coiled form.

17. The assembly as set forth in claim 1, wherein:

said substrate is comprised of a suitable material that is flexible so as to permit said substrate to he folded in a pleated array in order to permit said seam plates to be stacked in a nested array with respect to each other.

18. A roof decking assembly for facilitating the fixed mounting of roof membrane seam plates at predetermined locations upon an underlying roof decking substructure by means of fasteners, comprising:

an underlying roof decking substructure;

an insulation panel disposed atop said roof decking substructure;

a plurality of environmental membranes adapted to be fixedly secured atop said insulation panel;

at least one substrate, comprising at least one ply, having a longitudinal extent and a predetermined first transverse dimension as defined between oppositely disposed side edge portions; and a plurality of seam plates comprising a first seam plate and remaining seam plates, for fixing said plurality of environmental membranes upon said underlying roof decking substructure, said seam plates being affixed to said substrate independently of the fasteners and having second transverse dimensions which are not greater than said first transverse dimensions of said at least one substrate so as to be fixedly mounted upon said at least one ply of said at least one substrate in such a manner that said plurality of seam plates are disposed transversely inwardly between said oppositely disposed side edge portions of said at least one substrate, and at predeterminedly spaced positions spaced along said longitudinal extent of said at least one substrate, so as to define with said at least one substrate an integral product entity such that when said first seam plate of said plurality of seam plates is fixedly secured at a first location along said underlying roof decking substructure by means of a fastener, the remaining seam plates of said plurality of seam plates, fixedly attached to said at least one substrate at said predetermined positions spaced along said longitudinal extent of said at least one substrate, will inherently be disposed at predetermined locations along said underlying roof decking substructure at which said seam plates are to be fixedly secured by the fasteners so as to ensure the proper fixation of said seam plates to said underlying roof decking substructure whereby, fixation of the environmental membranes, upon said underlying roof decking substructure, will be ensured.

19. The assembly as set forth in claim 18, wherein:

said underlying roof decking substructure comprises a corrugated roof decking substructure, comprising a plurality of crest portions spaced from each other by means of predetermined distances; and said plurality of seam plates are fixedly mounted upon said at least one substrate at predeterminedly spaced positions which correspond to said predetermined distances defined between said plurality of spaced crest portions of said underlying corrugated roof decking substructure so as to ensure said plurality of seam plates being fixedly secured to said plurality of spaced crest portions of said underlying corrugated roof decking substructure.

20. The assembly as set forth in claim 18, wherein:

said underlying roof decking substructure comprises a non-corrugated roof decking substructure; and said plurality of seam plates are fixedly mounted upon said at least one substrate at predeterminedly spaced positions which will ensure the secure fixation of said environmental membranes to said underlying non-corrugated roof decking substructure in such a manner that said environmental membranes will exhibit uplifting wind force resistance so as to remain fixed to said underlying non-corrugated roof decking substructure despite being exposed to significant uplifting wind forces.

21. The assembly as set forth in claim 18, wherein:

each one of said plurality of seam plates has a plurality of projections extending downwardly from undersurface portions of each one of said plurality of seam plates for engaging each one of said plurality of environmental membranes; and said substrate has a substantially C-shaped cross-sectional configuration comprising an upper planar member disposed atop said plurality of seam plates, and a pair of lower planar flap-type members folded inwardly from opposite side edge portions of said upper planar member.

22. The assembly as set forth in claim 21, further comprising:

heat-sealed regions defined around peripheral edge portions of each one of said plurality of seam plates for securing each one of said plurality of seam plates to said substrate.

23. The assembly as set forth in claim 21, wherein:

each one of said plurality of seam plates has a predetermined lateral extent;

said upper planar member of said substrate has a lateral extent which is at least equal to said lateral extent of each one of said plurality of seam plates so as to cover upper surface portions of each one of said plurality of seam plates; and said flap-type members have lateral extents which are less than said predetermined lateral extent of each one of said plurality of seam plates such that when said flap-type members are folded beneath each one of said plurality of seam plates, said flap-type members will only partially cover undersurface portions of each one of said plurality of seam plates so as to enable at least some of said projections of said seam plates to freely engage said plurality of environmental membranes.

24. The assembly as set forth in claim 21, wherein:

each one of said plurality of seam plates has a predetermined lateral extent;

said upper planar member of said substrate has a lateral extent which is at least equal to said lateral extent of each one of said plurality of seam plates so as to cover upper surface portions of each one of said plurality of seam plates; and said flap-type members each have lateral extents which are approximately equal to one-half of said lateral extent of said upper planar member of said substrate such that when said flap-type members are folded beneath each one of said plurality of seam plates, said flap-type members will substantially cover entire undersurface portions of each one of said plurality of seam plates wherein said projections of said seam plates will engage said folded flap-type members of said substrate when said plurality of seam plates are secured to said underlying roof decking substructure so as to also engage said plurality of environmental membranes.

25. The assembly as set forth in claim 18, wherein:

each one of said plurality of seam plates has a plurality of projections extending downwardly from undersurface portions of each one of said plurality of seam plates for engaging each one of said plurality of environmental membranes; and said substrate has a substantially V-shaped cross-sectional configuration comprising an upper planar member disposed atop said plurality of seam plates, and a lower planar member folded along a first side edge portion of said substrate so as to be disposed beneath said plurality of seam plates wherein said projections of said seam plates will engage said lower planar member of said substrate when said plurality of seam plates are secured to said underlying roof decking substructure so as to also engage said plurality of environmental membranes.

26. The assembly as set forth in claim 25, further comprising:

heat-seal regions defined around peripheral edge portions of each one of said plurality of seam plates for securing each one of said plurality of seam plates to said substrate.

27. The assembly as set forth in claim 25, further comprising:

a longitudinally-extending heat seal region defined along a second oppositely disposed side edge portion of said substrate so as to affix said upper and lower planar members of said substrate together.

28. The assembly as set forth in claim 18, further comprising:

adhesive means for adhesively bonding upper surface portions of each one of said plurality of seam plates to said substrate.

29. The assembly as set forth in claim 18, further comprising:

foldable prong means mounted upon each one of said plurality of seam plates for piercing said substrate and securing each one of said plurality of seam plates upon said substrate when said foldable prong means are folded into engagement with said substrate so as to effectively entrap portions of said substrate between said folded prong means and each one of said plurality of seam plates.

30. The assembly as set forth in claim 18, wherein:

said substrate comprises a structure selected from the group comprising a suitable tape, paper, film, fabric, metal wire, metal sheet, batten strip, and batten bar.

31. The assembly as set forth in claim 18, wherein:

said substrate comprises at least a pair of substrates fixedly connected together along at least one longitudinally extending seam portion.

32. The assembly as set forth in claim 18, wherein:

said substrate comprises a flattened tubular member; and said plurality of seam plates are fixedly secured within said tubular member by means of heat-sealed peripheral regions.

33. The assembly as set forth in claim 18, wherein:

said substrate is comprised of a suitable material that is flexible so as to permit said substrate to be rolled into a coiled form.

34. The assembly as set forth in claim 18, wherein:

said substrate is comprised of a suitable material that is flexible so as to permit said substrate to be folded in a pleated array in order to permit said seam plates to be stacked in a nested array with respect to each other.

* * * * *